US005125548A

United States Patent [19]

Perrin et al.

[11] Patent Number: 5,125,548

[45] Date of Patent: Jun. 30, 1992

[54] PAPER TOWEL DISPENSER CABINET WITH HEAT SINK

[75] Inventors: Patrick C. Perrin, Rancho Palos Verdes; Jimmie L. Whittington, Diamond Bar, both of Calif.

[73] Assignee: James River Corporation, Oakland, Calif.

[21] Appl. No.: 644,283

[22] Filed: Jan. 22, 1991

[51] Int. Cl.[5] ..... B65H 35/04; B26F 3/02; A62C 3/00

[52] U.S. Cl. ..... 225/39; 225/10; 225/16; 169/48; 242/55.53; 312/38

[58] Field of Search ..... 225/39, 41, 10, 11, 225/12, 14, 15, 16, 46, 90; 242/55.2, 55.53; 312/37, 38; 169/45, 48, 54

[56] References Cited

U.S. PATENT DOCUMENTS

| | | | |
|---|---|---|---|
| 3,730,409 | 5/1973 | Ratti | 225/10 X |
| 4,260,117 | 4/1981 | Perrin et al. | 242/55.53 X |
| 4,666,099 | 5/1987 | Hoffman et al. | 225/10 X |

*Primary Examiner*—Frank T. Yost
*Assistant Examiner*—Clark F. Dexter
*Attorney, Agent, or Firm*—Thomas R. Lampe

[57] ABSTRACT

A paper towel dispenser cabinet including a rigid, metallic bottom plate of unitary construction connected to walls of the dispenser. The bottom plate improves the structural integrity of the dispenser cabinet and operates as a heat sink in the event paper toweling passing through an aperture in the bottom plate is ignited so that flame is extinguished before damaging the housing interior.

5 Claims, 3 Drawing Sheets

PAPER TOWEL DISPENSER CABINET WITH HEAT SINK

TECHNICAL FIELD

This invention relates to a paper towel dispenser cabinet. More particularly, the cabinet incorporates a rigid, metallic bottom plate of unitary construction which performs a number of desired functions. In addition to enhancing the structural integrity of the dispenser cabinet by stabilizing cabinet walls, the bottom plate operates as a heat sink which is operable to extinguish a towel fire such as that caused by vandals. In addition, the bottom plate incorporates a cutter blade and provides a hinged mounting for the dispenser cover.

BACKGROUND ART

Roll paper towel dispensers commonly are at least partially constructed of plastic material. For example, many roll paper towel cabinet constructions incorporate housing walls and covers wholly or partially constructed of plastic. Most forms of plastic, of course, burn when exposed to a flame and it is an unfortunate fact of life that roll paper towel dispensers installed at institutional locations increasingly have become the target of vandals who set on fire the free end of the toweling projecting from the dispenser. The flames then travel up the towel into the interior of the cabinet, damaging not only the cabinet itself but perhaps causing a major fire in the building.

DISCLOSURE OF INVENTION

The present invention relates to an improvement in a paper towel dispenser cabinet which is operable to extinguish flame in a paper towel before the flame has an opportunity to enter the cabinet interior and cause damage to either the cabinet itself or its surroundings. Furthermore, the improvement enhances the structural stability of the cabinet.

The paper towel dispenser cabinet incorporating the improvement includes a housing having an interior at least partially defined by a back wall and side walls, and a cover for selective engagement with the side walls. The side walls and the cover are at least partially formed of plastic.

More specifically, the improvement comprises a rigid, metallic bottom plate of unitary construction interconnected with lower ends of the side and back walls, extending therebetween, and enhancing the structural integrity of the dispenser cabinet by stabilizing the side and back wall lower ends.

The rigid, metallic bottom plate defines an aperture for the passage of paper toweling from a paper towel roll disposed within the dispenser cabinet interior to a location external of said cabinet and below the bottom plate.

The bottom plate includes a cutter blade closely adjacent to the aperture for cutting the paper toweling. The bottom plate also includes hinge elements cooperable with hinge elements on the cover to pivotally mount the cover relative to the housing.

The bottom plate is of sufficient mass to operate as a heat sink in the event paper toweling passing through the aperture is ignited to extinguish flame on the towel before the flame damages the housing interior. The aperture is spaced from the side and back walls and from the hinge elements a sufficient distance to enable the bottom plate to absorb and dissipate heat from burning toweling without heat damage occurring to the back wall, the side walls and the cover.

Other features, advantages, and objects of the present invention will become apparent with reference to the following description and accompanying drawings.

BEST MODE FOR CARRYING OUT THE INVENTION

Figure 1:
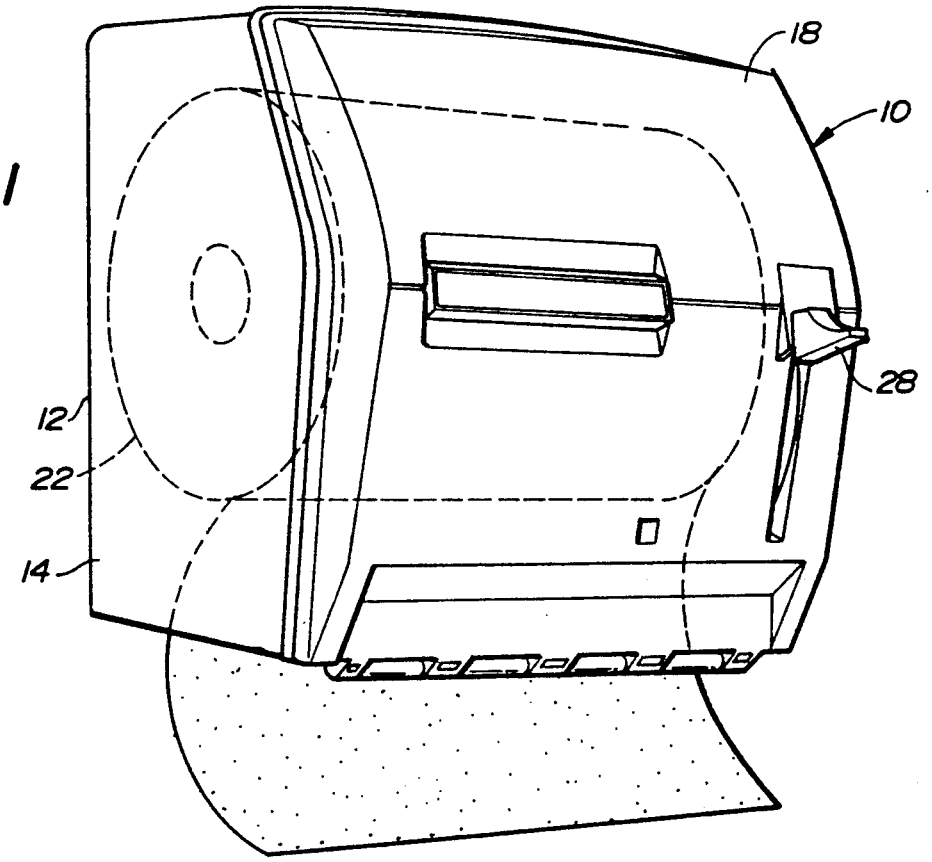
FIG. 1 is a perspective view of a paper towel dispenser cabinet incorporating the teachings of the present invention with the cover thereof closed.
Figure 3:
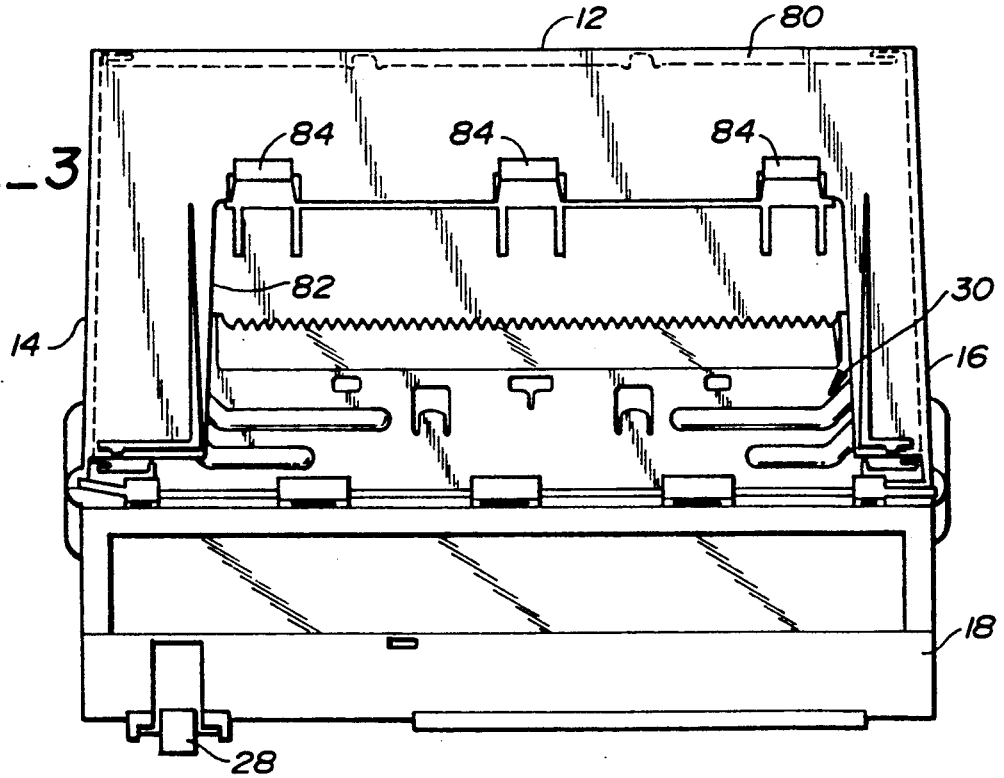
FIG. 3 is a bottom view of the paper towel dispenser cabinet.
Figure 2:
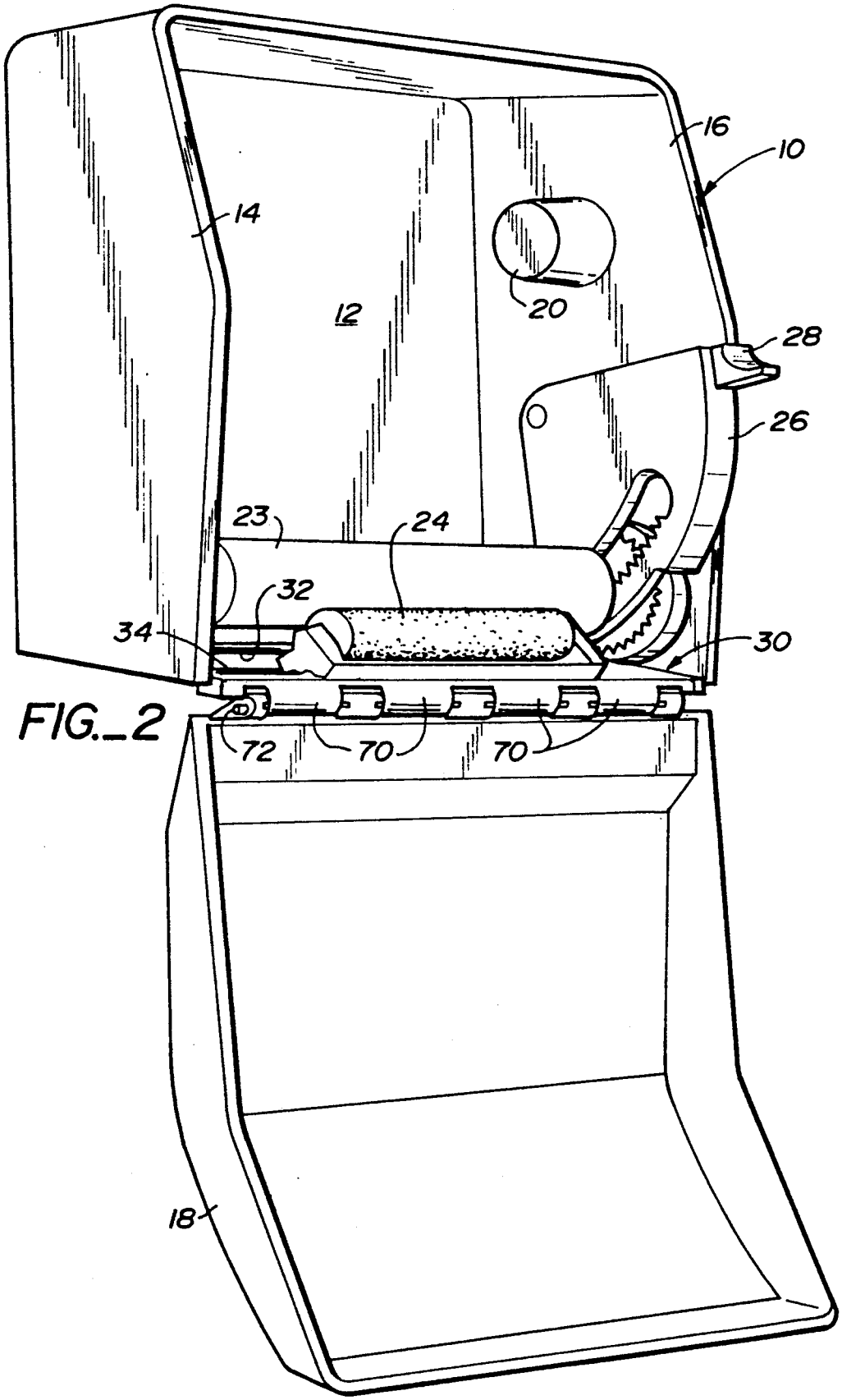
FIG. 2 is a view similar to that of FIG. 1 but illustrating the cover in an open position.

FIGS. 1-3 illustrate a paper towel dispenser cabinet incorporating the teachings of the present invention. As is conventional, the cabinet includes a housing 10 including a back wall 12, side walls 14, 16, and a cover 18 for selective engagement with the side walls. Through a suitable hinge arrangement which will be described in greater detail below, the cover may move from a closed position shown in FIG. 1 to an open position illustrated in FIG. 2. When the cover is in the latter position, the interior of the housing is exposed for servicing by an attendant in a well-known manner.

Suitable means, such as projections extending inwardly from the side walls (see representative projection 20 in FIG. 2), are employed to support a roll paper towel 22 in a well-known manner.

Also as is conventional, the dispenser cabinet includes suitable means for dispensing the toweling from the cabinet. In the arrangement shown, such means includes two nip rollers 23, 24 through which the toweling passes and a manually actuated transmission 26 for imparting rotational movement to the nip rollers upon depression of an associated handle 28. These latter features are not described in detail since they are well known in the prior art and form no part of the present invention.

It is quite common for a housing of the type illustrated and the cover therefor to be of relatively thin-wall plastic construction. Unless stabilized in some manner, the side walls, especially the bottoms thereof, have a degree of instability. Furthermore, most forms of plastic burn and ignition of the toweling tail projecting from the bottom of the cabinet by a vandal can cause flame to enter the cabinet interior, damage the cabinet, and even set it ablaze to cause more wide-spread damage.

As stated above, objectives of the present invention are to remedy the structural deficiencies found in some prior art cabinets, especially with regard to side wall flexing, and to provide a means whereby a flame is extinguished or snuffed out before the cabinet can be damaged to any significant degree.

More specifically, the improvement of the present invention is in the form of a rigid, metallic bottom plate of unitary construction connected to the lower ends of the side and back walls, substantially extending therebetween, and enhancing the structural integrity of the dispenser cabinet by stabilizing the side and back wall lower ends.

The bottom plate, as may be seen with reference to FIGS. 3–6, is designated by reference numeral 30. The bottom plate defines an aperture 32 for the passage of paper toweling from paper towel roll 22 disposed within the dispenser cabinet interior to a location external of the cabinet and below the bottom plate.

The bottom plate 30, which may for example be constructed of stamped steel sheeting, has an upwardly disposed planar surface 34. The plate includes a pair of spaced side segments 36, 38 and a pair of spaced front and back segments 40, 42, respectively, which define the aperture 32.

The disclosed bottom plate includes an integrally formed cutter blade 44 having a plurality of teeth 46. Cutter blade 44 extends downwardly from planar surface 34 and defines an obtuse angle with respect thereto. The cutter teeth 46 are, of course, disposed below the planar surface. The cutter blade 44 slants downwardly from the innermost edge of front segment 40 so that the blade angles downwardly and inwardly with respect to the rest of the cabinet.

A plurality of elongated embossments are formed in the segments 36, 38, 40 and 42. The elongated embossments formed in side segment 36 are identified by reference numerals 48, 50, those in side segment 38 by reference numerals 52, 54, those in front segment 40 by reference numerals 56, 58, and those in back segment 42 by reference numerals 60, 62.

Figures 4, 5, 6:
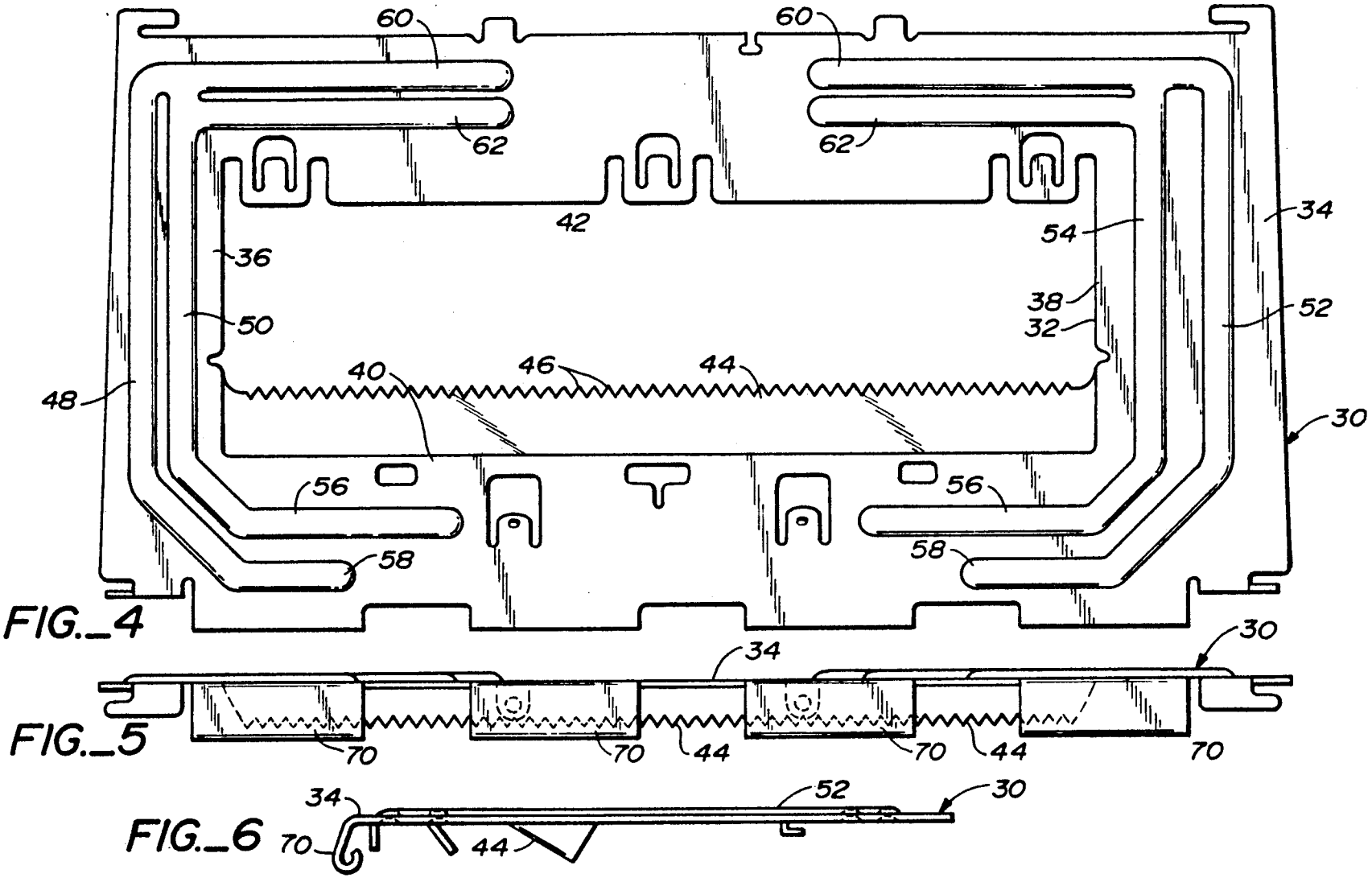
FIG. 4 is an enlarged, plan view of the rigid, metallic bottom plate of unitary construction incorporated in the paper towel dispenser cabinet.
FIG. 5 is a front, elevational view of the bottom plate.
FIG. 6 is a side view of the bottom plate.

As may clearly be seen with reference to FIG. 4, the elongated embossments are formed in the segments at least partially about and closely adjacent to the aperture 32. In each segment the elongated embossments are disposed in pairs, the embossments of each pair being spaced from one another and parallel. It should also be noted that elongated embossments in each segment are integral with elongated embossments of adjoining segments.

The elongated embossments project upwardly from the planar surface 34 and the embossment construction just described resists flexing of the bottom plate and adds strength and stability thereto. Furthermore, the elongated embossments will serve to radiate and dissipate heat energy from the bottom plate when the bottom plate is heated as, for example, by flames from toweling engaging the bottom thereof.

The bottom plate 30 is operable as a heat sink in the event the paper toweling passing through the aperture is ignited to extinguish flame on the towel before the flame enters the housing interior. That is, sufficient heat energy is absorbed by the bottom plate to extinguish the toweling fire at the point where the tail of the toweling projects below aperture 32. To perform this function the front and back segments should be closely adjacent to one another whereby the aperture is of relatively narrow width. Preferably the aperture width is in the order of about 1¾ inches or less. Also, of course, the bottom plate must be of sufficient mass to operate as a heat sink.

Bottom plate 30 also performs another function. The bottom plate 30 includes spaced hinge elements 70 which project downwardly from the front edge of front segment 40. The cover 18 has cooperating hinge elements which project between hinge elements 70 and a pivot pin 72 (FIG. 2) extends through all of the hinge elements to provide a pivotal attachment between the cover 18 and the housing 10. Embossments 48–62 enhance the strength of the bottom plate and render the bottom plate readily capable of supporting the extra weight of the cover.

Any suitable means may be employed to attach the bottom plate 30 to the housing 10. Suitable expedients are brackets, clips, screws or other fasteners. In the arrangement illustrated, a tray 80 (FIG. 3) is integral with and extends inwardly from side walls 14, 16 and back wall 12. The tray 80 is recessed at 82. The bottom plate is slid into position over the tray and a portion of the bottom plate is exposed at said recess. Suitable clip means such as those designated by reference numeral 84 may be employed to retain the bottom plate 30 in position relative to the housing.

We claim:

1. In a paper towel dispenser cabinet including a housing having an interior at least partially defined by a back wall and side walls connected to said back wall, and a cover for selective engagement with said side walls, said side walls and said cover being at least partially formed of plastic, the improvement comprising a rigid, metallic bottom plate of unitary construction interconnected with lower ends of said side and back walls, substantially extending therebetween, and enhancing the structural integrity of said dispenser cabinet by stabilizing said side and back wall lower ends, said rigid, metallic bottom plate defining an aperture for the passage of paper toweling from a paper towel roll disposed within said dispenser cabinet interior to a location external of said cabinet and below said bottom plate for cutting said paper toweling, said bottom plate including hinge elements cooperable with hinge elements on said cover to pivotally mount said cover relative to said housing, said bottom plate having an upwardly disposed planar surface and said cutter blade extending downwardly from said planar surface, defining an obtuse angle with respect thereto, said cutter blade including a plurality of cutter teeth disposed below said planar surface; said bottom plate including a pair of spaced side segments and a pair of spaced front and back segments connected to said side segments, said bottom plate segments defining said apertures, a plurality of elongated embossments being formed in said segments at least partially about and closely adjacent to said aperture, said elongated embossments projecting upwardly from said planar surface and operable to resist flexing of said bottom plate and to radiate and dissipate heat energy from said bottom plate when said bottom plate is heated by ignited toweling.

2. The apparatus according to claim 1 wherein a plurality of elongated embossments are formed in each segment, said elongated embossments in each segment being spaced from and parallel to one another.

3. The apparatus according to claim 2 wherein said elongated embossments in each segment are integral with said elongated embossments of adjoining segments.

4. The apparatus according to claim 1 wherein the front and back segments are closely adjacent to one another whereby said aperture has a narrow width.

5. The apparatus according to claim 4 wherein said aperture width is no more than about 1¾ inches.

* * * * *